US011047199B2

(12) United States Patent
Sredensek

(10) Patent No.: US 11,047,199 B2
(45) Date of Patent: Jun. 29, 2021

(54) HYDRAULIC WORKOVER UNIT FOR LIVE WELL WORKOVER

(71) Applicant: Halliburton Energy Services, Inc., Houston, TX (US)

(72) Inventor: Herwig Michael Sredensek, Wickenburg, AZ (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/681,070

(22) Filed: Nov. 12, 2019

(65) Prior Publication Data

US 2021/0140260 A1 May 13, 2021

(51) Int. Cl.

| | |
|---|---|
| ***E21B 33/064*** | (2006.01) |
| ***E21B 19/02*** | (2006.01) |
| ***E21B 19/00*** | (2006.01) |
| ***E21B 33/06*** | (2006.01) |
| ***E21B 19/086*** | (2006.01) |

(52) U.S. Cl.

CPC ..... *E21B 33/064* (2013.01); *E21B 19/004* (2013.01); *E21B 19/02* (2013.01); *E21B 19/086* (2013.01); *E21B 33/06* (2013.01)

(58) Field of Classification Search

CPC ..... E21B 33/064; E21B 19/004; E21B 19/02; E21B 19/00; E21B 19/0086

See application file for complete search history.

(56) References Cited

U.S. PATENT DOCUMENTS

| | | | | |
|---|---|---|---|---|
| 2,090,854 A * | 8/1937 | Timbs | E21B 19/00 173/149 |
| 3,797,570 A * | 3/1974 | Leutwyler | E21B 19/00 166/77.4 |
| 6,158,516 A | 12/2000 | Smith et al. | |
| 10,072,486 B2 | 9/2018 | Bennett et al. | |
| 2002/0117308 A1 | 8/2002 | Dallas | |

(Continued)

FOREIGN PATENT DOCUMENTS

| | | | |
|---|---|---|---|
| WO | WO-2017030847 A1 * | 2/2017 | E21B 33/06 |
| WO | WO-2019100143 A1 * | 5/2019 | E21B 33/068 |

OTHER PUBLICATIONS

Korean Intellectual Property Office, International Search Report and Written Opinion, PCT/US2019/060908, dated Aug. 11, 2020, 13 pages, Korea.

*Primary Examiner* — James G Sayre

(57) ABSTRACT

A workover unit for lowering an irregularly shaped production string into a live well includes a traveling assembly and stationary assembly movable relative to each other. The traveling assembly may include a traveling static annular BOP configured to seal around the production string during the lowering. The traveling assembly may include a reciprocating riser connected to the traveling annular BOP. The traveling assembly may include traveling slips configured to grip the production string during the lowering. The stationary assembly may include a dynamic BOP configured to seal around the reciprocating riser during the lowering. The stationary assembly may include a reciprocating jack configured to lower the traveling assembly. The stationary assembly may include a lower static annular BOP configured to seal around the production string when the traveling assembly is moved relative to the production string.

20 Claims, 7 Drawing Sheets

(56) References Cited

U.S. PATENT DOCUMENTS

| | | | | |
|---|---|---|---|---|
| 2004/0262015 | A1* | 12/2004 | Mazzella | E21B 19/16<br>166/383 |
| 2008/0302530 | A1 | 12/2008 | Shampine et al. | |
| 2016/0258232 | A1* | 9/2016 | Harper | E21B 19/086 |

* cited by examiner

HYDRAULIC WORKOVER UNIT FOR LIVE WELL WORKOVER

TECHNICAL FIELD OF THE INVENTION

The disclosure relates, in general, to hydrocarbon production, and more particularly, to electrical submersible pump (ESP) completions utilized in the production of hydrocarbons. Most particularly, the disclosure relates to a hydraulic workover unit for performing a live well workover involving ESP completions.

BACKGROUND OF THE INVENTION

Oil wells are commonly overbalanced, wherein wellbore pressure exceeds formation fluid pressure preventing the well from flowing. In many instances, overbalanced wells require artificial lift to produce. One common type of artificial lift uses an electrical submersible pump (ESP), which is lowered into the well on a production tubing string. Power is supplied to the ESP by an electrical cable that is clamped or banded to the outer diameter of the tubing string. Because the wells are overbalanced, when workover on the well is required, traditional kill weight fluids, such as water, cannot be used because the kill weight fluid could damage the already overbalanced well.

Where wells cannot be killed, the only option is a live well (snubbing) workover, whereby the well remains under pressure during the workover. In such snubbing operations, equipment is run into the well on a pipe string using a hydraulic workover rig. Unlike wireline or coiled tubing, the pipe sections that make up the pipe string are not spooled off a drum, but made up and broken up while running in and pulling out, much like conventional drill pipe. However, even in wells that are overbalanced such that formation fluids are not flowing to the surface, there may be gas, such as hydrogen sulfide ($H_2S$) existing in the well between the formation fluid column in the well and the surface. This gas must be taken into consideration and contained during live well workovers. Thus, blow out preventer are positioned between the wellhead and the hydraulic jack utilized in the snubbing workover to trip tubing string in and out of the well. Where the tubing string is annular in cross-section, the BOP may be a conventional annular BOP with a dynamic seal that retains the seal as the tubing string is passed through the BOP.

BRIEF DESCRIPTION OF THE DRAWINGS

For a detailed description of exemplary embodiments, reference will now be made to the accompanying drawings in which.

DETAILED DESCRIPTION

The embodiments described herein include a hydraulic workover system configured for performing live well workover during electrical submersible pump (ESP) completion operations, thereby permitting the ability to insert jointed pipe production string with an ESP cable attached thereto into an underground wellbore without killing the well. Generally, the hydraulic workover system includes a hydraulic jack having a first portion reciprocally movable relative to a second portion, with a first static annular blow out preventer mounted on one portion and a second dynamic blowout preventer mounted on the other portion. The first static blow out preventer has a tubular riser attached thereto, which tubular riser extends through and is sealingly engaged by the second dynamic blow out preventer. The hydraulic jack can be actuated to axially move the tubular riser through the second dynamic blow out preventer. In one or more embodiments, a first end of a tubular spool is attached to the second blow out preventer and a third static annular blow out preventer is attached to a second end of the spool so that the second and third blowout preventers are fixed relative to one another. A cross-over valve may be provided between the second blowout preventer and the third blowout preventer. The first and third blowout preventers each include one or more deformable elastomeric sealing elements, while the second blow out preventer includes one or more rigid elastomeric sealing elements. In operation, as the hydraulic jack is utilized to raise or lower an irregularly shaped tubing string, only one of the first or third blowout preventers is utilized at any given time to seal around the tubing string, such that either the first and second blow out preventers are providing sealing during actuation of the jack, or the second and third blow out preventers are providing sealing during actuation of the jack.

Figure 1:
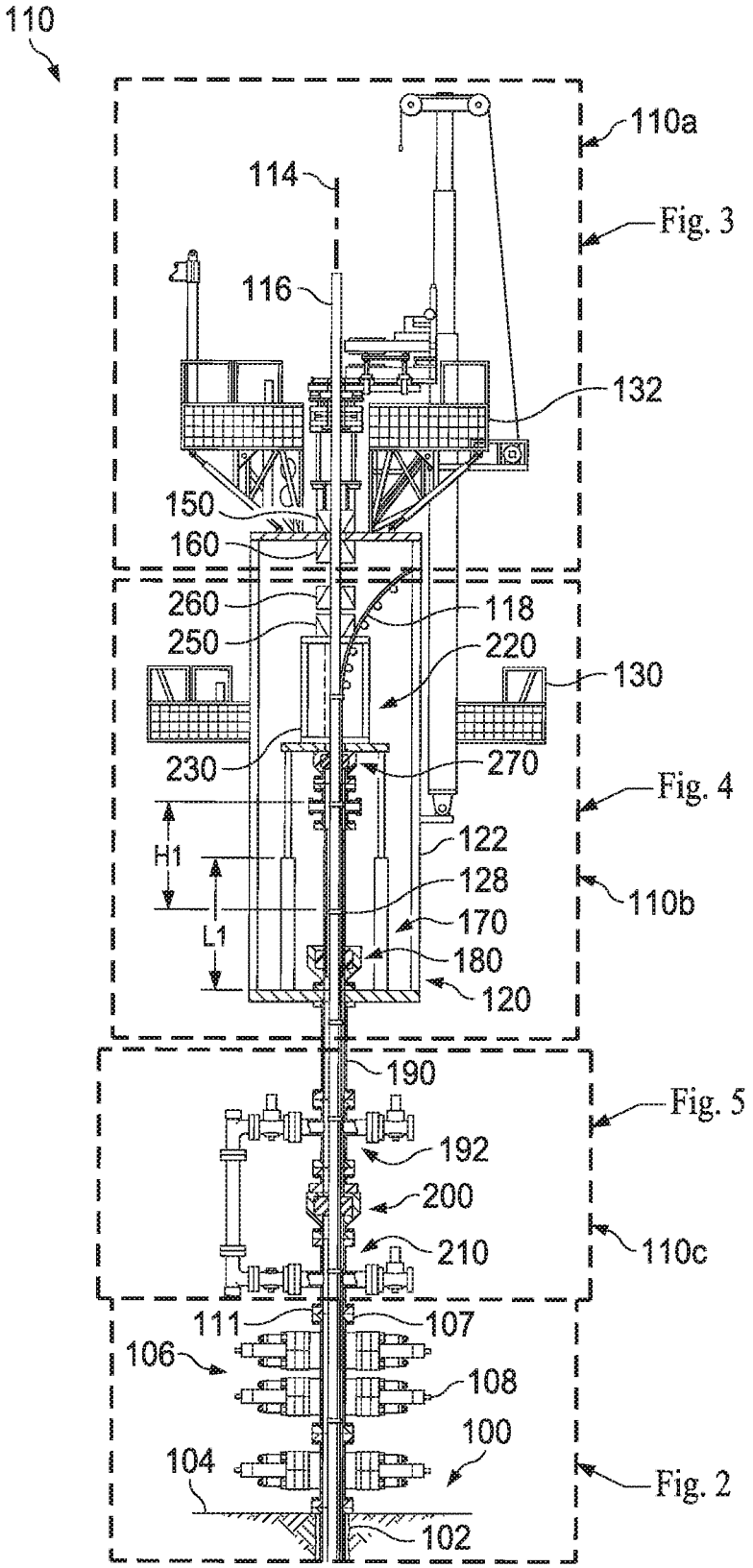
FIG. 1 is a front elevation view of a hydraulic workover unit in accordance with the teachings herein.

FIG. 1 is a front elevation view of a hydraulic workover unit. Specifically, shown is a well site 100 that includes an underground wellbore 102 extending from a surface 104. A wellhead 106 may be disposed at surface 104 above wellbore 102. In the illustrated embodiment, wellhead 106 includes one or more BOPs 108. In one embodiment, BOPs 108 may be ram-type BOPs. However, in other embodiments wellhead 106 may include, without limitation, various other annular BOPs, housings, valves, and flanges. In any event, a workover system 110 is attached to wellhead 106 above the BOPs 108. It will be appreciated that hydraulic workover system 110 may be utilized with any wellhead 106 and the above description of wellhead 106 is for illustrative purposes only. In one or more embodiments, a portion of wellhead 106 may be provided as part of hydraulic workover system 110.

As shown, workover system 110 may be disposed above wellhead 106 which may structurally support workover system 110. In one or more embodiments, workover system 110 may be supported externally by a crane or other structure (not shown) or supported by both a crane and wellhead 106. Workover system 110 may include a first or lower flange 111. In one or more embodiments, first flange 111 is disposed for attachment to wellhead 106. In the illustrated embodiment, first flange 111 of workover system 110 is bolted to second flange 107 of wellhead 106. The flanged connection provides a structural and pressure-containing interface between wellhead 106 and workover system 110.

Figure 2:
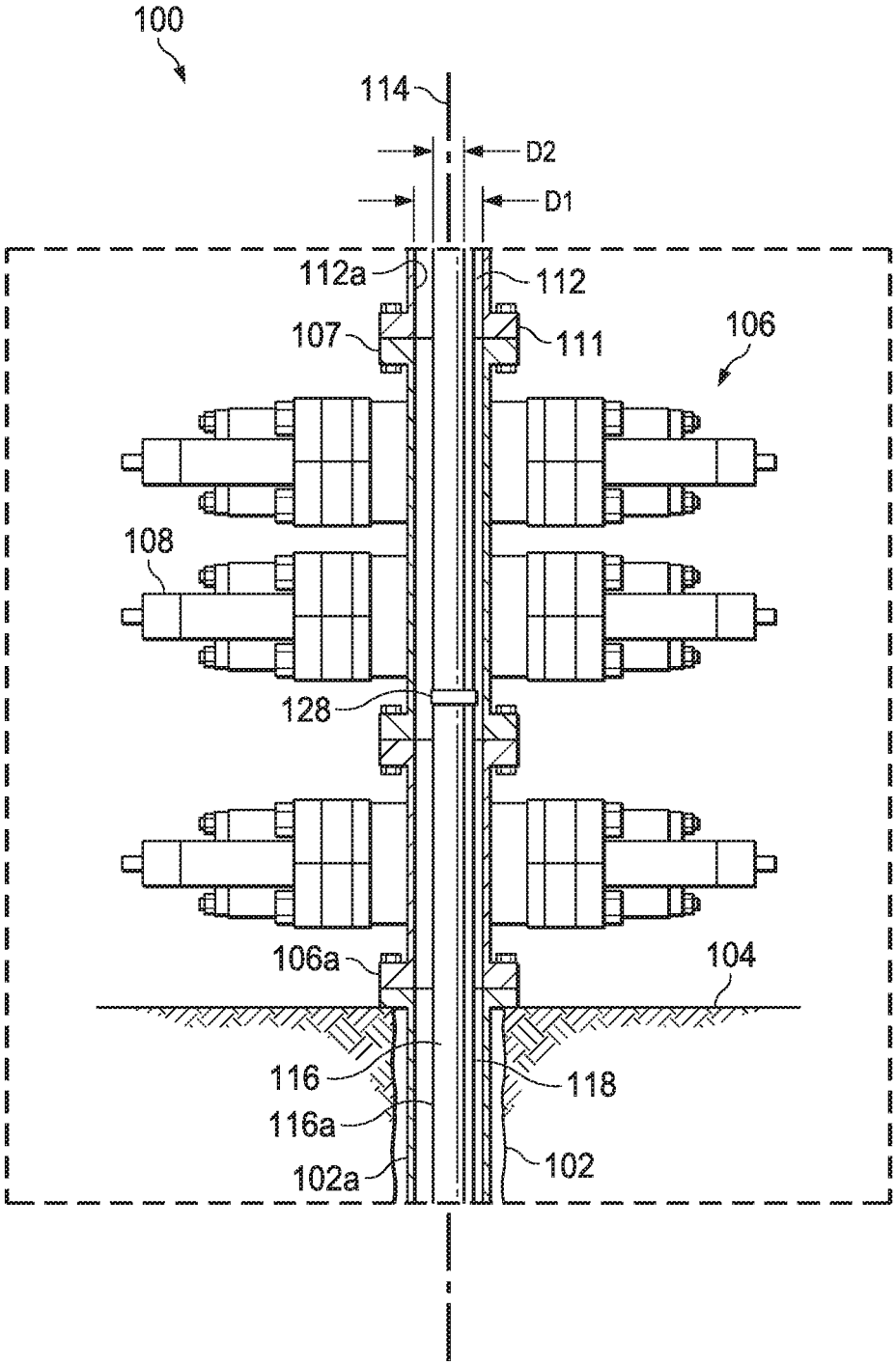
FIG. 2 is a close-up front elevation view of a wellhead attached at a lower end of the hydraulic workover unit of FIG. 1.

FIG. 2 is a close-up front elevation view of a wellhead attached at a lower end of the hydraulic workover unit of FIG. 1, and in particular, illustrates wellhead 106 in more detail. Wellhead 106 may include one or more BOPs 108. A bore 112 is formed through wellhead 106 generally about longitudinal axis 114. Workover system 110 is generally axially aligned with longitudinal axis 114 so that various components of workover system 110 can be in fluid communication with bore 112. Bore 112 includes an inner surface 112*a* having an inner diameter D1. Wellhead 106 is configured to provide a structure for suspending a casing string 102*a* used to line wellbore 102. Furthermore, wellhead 106 is configured to provide pressure containment between wellbore 102 and surface 104. Wellhead 106 may include a first, lower, or hanger flange 106*a* and a second or upper flange 107. In one or more embodiments, first flange 106*a* is disposed for attachment to a casing string 102*a* and second flange 107 is disposed for attachment to workover system 110. A production string 116 may be disposed in bore 112 along longitudinal axis 114. Production string 116 includes an outer surface 116*a* having an outer diameter D2. Outer diameter D2 may be smaller than inner diameter D1 of bore 112 to enable production string 116 to pass freely through bore 112. It will be appreciated that when workover system 110 is connected to wellhead 106 as described herein, wellbore 102, wellhead 106, and bore 112 substantially align so that production string 116 may extend from within wellbore 102, through wellhead 106, through bore 112, and above workover system 110 (see FIG. 1). Production string 116 may include a cable 118 attached to outer surface 116*a*. Cable 118 may be secured to outer surface 116*a* of production string 116 using fasteners 128, such as clamps.

Turning back to FIG. 1, workover system 110 includes an upper portion 110*a*, a middle portion 110*b* and a lower portion 110*c*. Lower portion 110*c* engages wellhead 106 via first flange 111 and generally includes a lower annular BOP 200 with a tubular 190, such as an extension spool, extending up from lower annular BOP 200 along axis 114. Lower annular BOP 200 is a statically sealing BOP. In one or more embodiments, an upper flow cross assembly 192 and a lower flow cross assembly 210 may be provided to direct flow around lower annular BOP 200 as described below. Middle portion 110*b* of workover system 110 generally includes a stationary assembly 120 and a traveling assembly 220 which reciprocates along axis 114 relative to stationary assembly 120 for stripping production string 116 to which cable 118 is attached. In this regard, middle portion 110*b* functions as the feed point for joining cable 118 to production string 116 using fasteners 128. This is typically performed adjacent a lower work platform such as first work platform 130 within a traveling window 230. In any event, middle portion 110*b* includes a frame 122 which supports an actuation mechanism 170, such as a reciprocating jack 170, to move traveling assembly 220 relative to stationary assembly 120. Stationary assembly 120 includes a stationary or fixed BOP 180 to which the extension spool or tubular 190 of lower portion 110*c* attached, thereby fixing stationary BOP 180 and lower annular BOP 200 relative to one another. Stationary BOP 180 is a dynamically sealing BOP. Traveling assembly 220 includes a traveling annular BOP 270 which is reciprocated by jack 170 relative to stationary BOP 180. Traveling annular BOP 270 is a statically sealing BOP. Traveling assembly 220 may also include a first set of traveling slips 260 generally adjacent second set of traveling slips 250. Upper portion 110*a* generally incudes a first set of upper slips 150, such as heavy slips, and a second set of upper slips 160, such as snub slips, utilized to attach and detach pipe sections from production string 116 from an upper work platform such as second platform 132. As stated above, various components of workover system 110 generally axially aligned along longitudinal axis 114 such that traveling annular BOP 270, dynamic BOP 180 and stationary annular BOP 200 are all generally axially aligned.

As described herein, dynamic BOPs typically refer to BOPs that include one or more solid elastomeric seal elements that are actuated with a piston, plungers, rams, linkage or similar mechanical structure to urge the elastomeric seal element(s) into engagement with a tubing string. In this regard, dynamic BOP may be an annular BOP or a ram BOP. Where an irregular shaped tubing string is being tripped in or out of the wellbore, such as would be the case where an ESP is deployed on the tubing string and an electrical cable clamped to the outer diameter of the tubing string, conventional dynamic BOPs with seal elements as described above cannot be utilized because such BOPs, and in particular, their seal elements, will not seal around irregular shaped or non-round tubing strings. However, there is a class of annular BOPs that employ soft elastomeric seal elements that can adapt to irregular shaped tubing string to form a seal around the tubing string. Typically, such seal elements are typically inflatable, with a pressure cavity formed within the seal element and disposed for receipt of a pressurized activation fluid in order to expand the seal element around an irregular shape. It will be appreciated that such BOPs do not require any moving parts such as pistons to activate, but simply function as pressure to close; vent to open type devices. However, because the seal element inflates to seal around a pipe string, such "soft" seal element BOPs are static in nature, and are referred to herein as static annular BOPs. Static annular BOPs cannot satisfy the dynamic needs required for snubbing workovers where ESP production tubing is involved.

With respect to production string 116 and cable 118, fasteners 128 may be spaced apart from one another by a distance HE The distance H1 may correspond to a stroke length L1 of workover system 110. However, it will be appreciated that any spacing may be used. As used herein, production string 116 may generally refer to any type of tubing, including without limitation jointed pipe or coiled tubing and may or may not include cable 118 disposed on outer surface 116*a*. When production string 116 includes cable 118, production string 116 may have a non-circular or other irregularly-shaped outer surface 116*a*. However, even when production string 116 does not include cable 118, production string 116 may include components having a non-circular or other irregularly shaped outer surface 116*a*, including without limitation some types of pipe or tubing, downhole tools, a gas lift side-pocket mandrel, or any other irregularly shaped wellbore implements known in the art. As used herein, cable 118 may generally refer to any type of cable or tubing attached to outer surface 116*a* of production string 116, including without limitation an ESP cable, a subsurface safety valve (SSSV) control line tubing, an external capillary string, an electrical or hydraulic tubing, an external tubing on a gas lift mandrel, or any other control line cable or tubing known in the art. As used herein, fastener 128 is not limited to a particular type of fastener. In one or more embodiments, fastener 128 may be conventional tubing clamps having a low profile as is known in the industry. It will be appreciated that when production string 116 includes cable 118 and clamps 128, then outer diameter D2 may correspond to a major diameter of production string 116, cable 118, and clamps 128 and outer diameter D2 may exceed a diameter of outer surface 116*a*.

As described above, workover system 110 includes a stationary assembly 120 and a traveling assembly 220, which may move relative to stationary assembly 120 along longitudinal axis 114. Stationary assembly 120 may include a frame 122 for structurally supporting a first or lower work platform 130 and a second or upper work platform 132. Frame 122 supports first work platform 130 below second work platform 132. In one or more embodiments, to be described later, first work platform 130 may alternatively be attached to traveling assembly 220 instead of being attached to stationary assembly 120, thus making first work platform 130 movable relative to stationary assembly 120.

Figure 3:
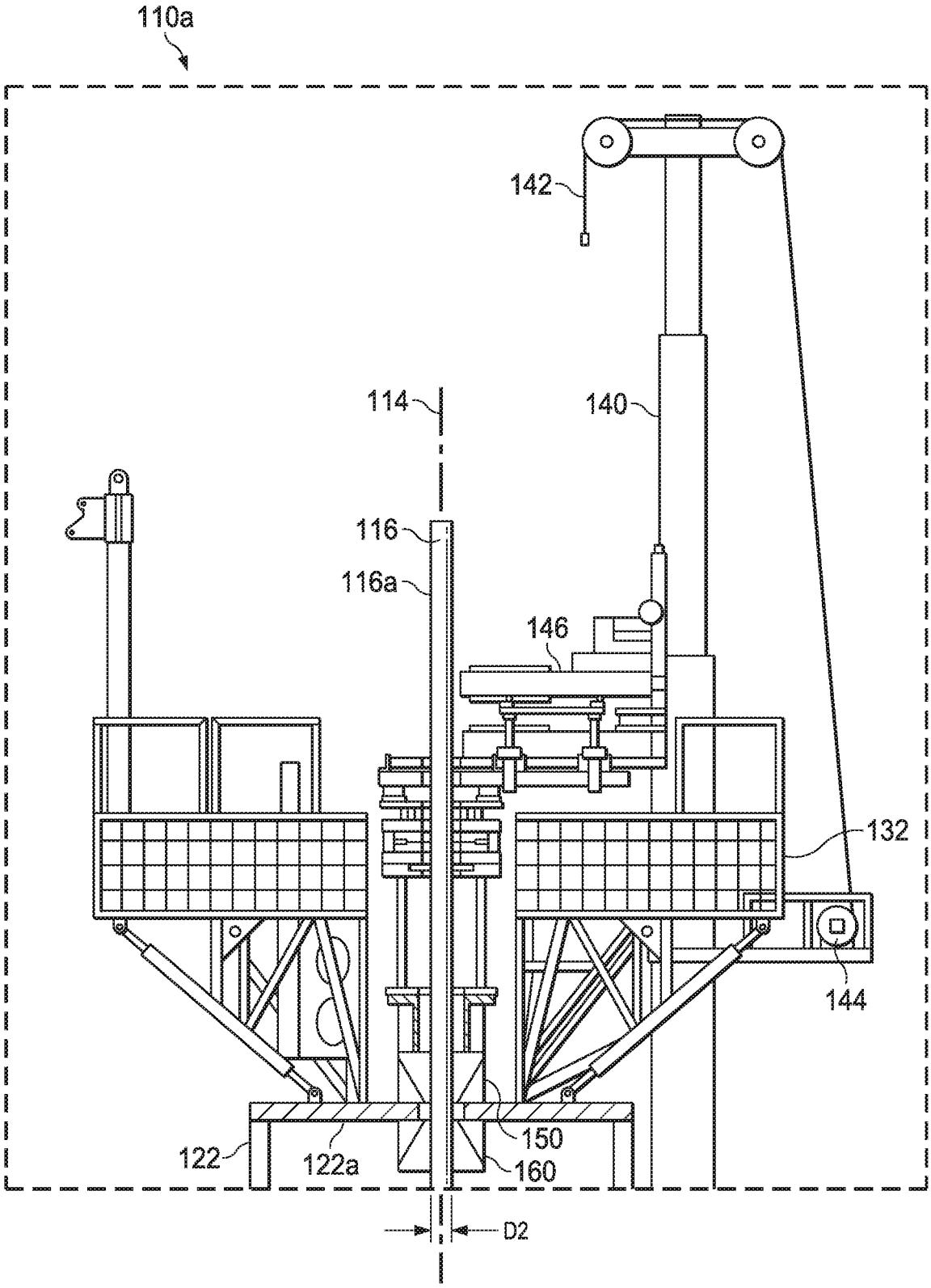
FIG. 3 is a close-up front elevation view of an upper portion of the hydraulic workover unit of FIG. 1.

FIG. 3 is a close-up front elevation view of an upper portion of the hydraulic workover unit of FIG. 1, and in particular, illustrates upper portion 110*a* of workover system 110 in more detail. Frame 122 includes a first or upper end 122*a* disposed for attachment to second work platform 132. Frame 122 further supports a gin pole 140 having a cable 142 suspended therefrom. Cable 142 includes a first end attached to a winch 144 and a second end attached to an elevator (not shown). Gin pole 140 may use the elevator to lift and/or lower a section of production pipe between surface 104 and second work platform 132. In one or more embodiments, gin pole 140 may be sized to suspend an upper end of the joint of production pipe by as much as 32 feet above second work platform 132 while maintaining tension using winch 144. Second work platform 132 may include a pipe tong 146 for making-up or breaking-out a connection between the production pipe section and production string 116. Pipe tong 146 may be disposed on second work platform 132. In one or more embodiments, pipe tong 146 may be suspended from a tong arm (not shown) attached to second work platform 132. In one or more embodiments, pipe tong 146 may be suspended from a tong arm (not shown) attached to gin pole 140. In one or more embodiments, pipe tong 146 may rotated into and out of alignment with longitudinal axis 114 in order to make-up or break-out the connection. When the connection is made-up, production string 116 may extend from the elevator down through workover system 110 and into wellbore 102. In one or more embodiments, during operation, as production string 116 is run into wellbore 102, cable 142 and winch 144 maintain tension on production string 116 while a second winch (not shown) lowers a second cable (not shown) to surface 104 to simultaneously lift a next joint of production pipe to second work platform 132. In one or more embodiments, workover system 110 may include one or more control consoles, including without limitation a BOP operator console, a winch console, and a jack operator console (not shown). In one or more embodiments, various functions of the one or more control consoles may be combined into a single console and/or controlled remotely.

Stationary assembly 120 (see FIG. 1) further includes a first set of upper stationary slips 150 and a second set of upper stationary slips 160 located in a fixed position at about a height of second work platform 132. First set of upper stationary slips 150 may be heavy slips while second set of upper stationary slips 160 may be snub slips. Stationary heavy slips 150 are configured to grip and hold production string 116 stationary in a pipe heavy condition, wherein a balance of forces on production string 116 is downward. Stationary snub slips 160 are configured to grip and hold production string 116 stationary in a pipe light condition, wherein a balance of forces on production string 116 is upward. In one or more embodiments, stationary slips 150, 160 may have a weight capacity that ranges from about 150,000 pounds to about 600,000 pounds. More particularly, the weight capacity may range from about 150,000 pounds to about 460,000 pounds. In one non-limiting example, stationary slips 150, 160 may have a weight capacity of 340,000 pounds. In one or more embodiments, stationary slips 150, 160 may have inner diameter D1 greater than outer diameter D2 of production string 116.

Figure 4:
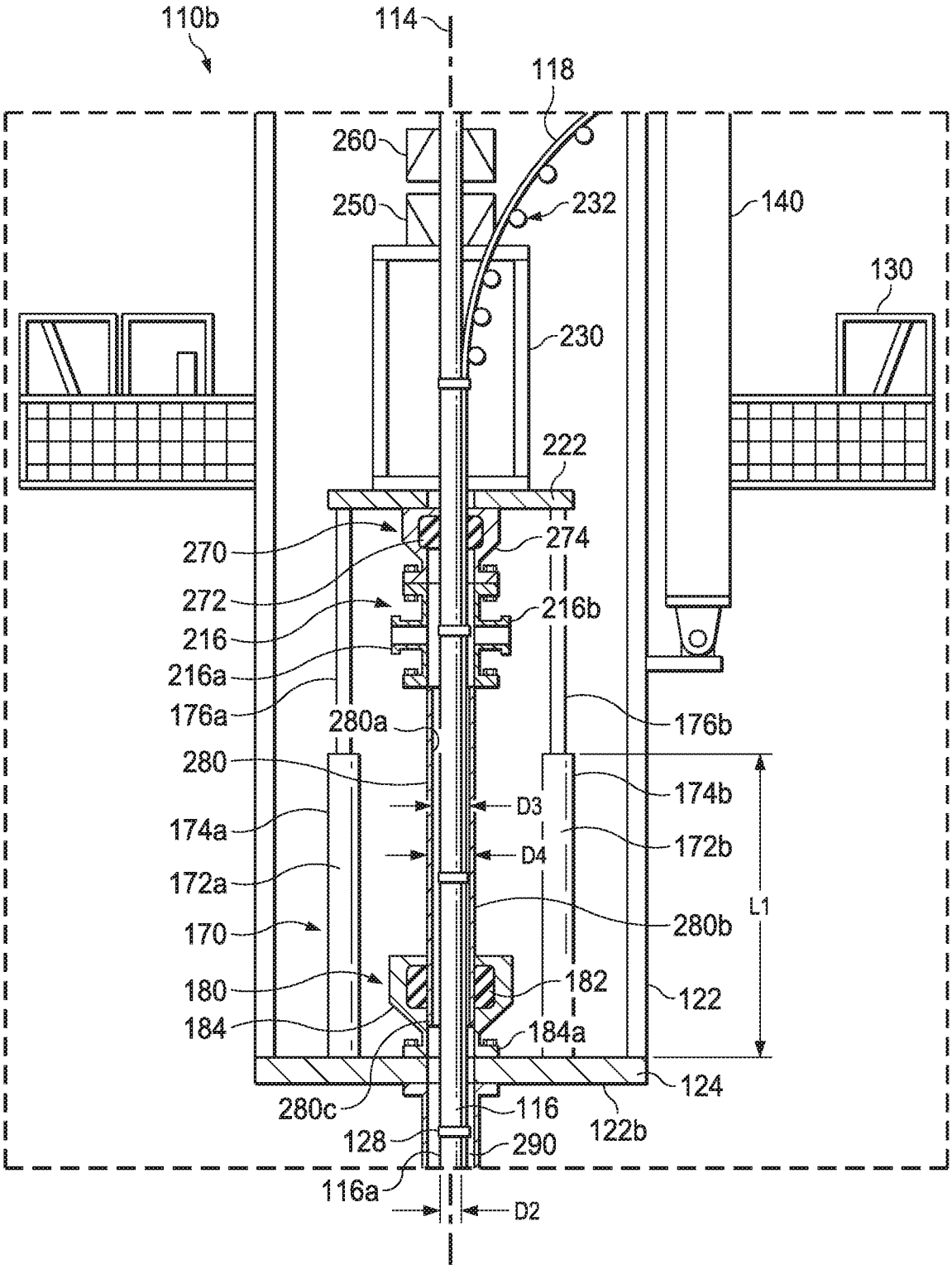
FIG. 4 is a close-up front elevation view of a middle portion of the hydraulic workover unit of FIG. 1.

FIG. 4 is a close-up front elevation view of a middle portion of the hydraulic workover unit of FIG. 1, and in particular, illustrates middle portion 110*b* of workover system 110 in more detail. Stationary assembly 120 has a base plate 124 to which a second or lower end 122*b* of frame 122 attaches. Reciprocating jack 170 is disposed adjacent second end 122*b* of frame 122. In one or more embodiments, jack 170 may be disposed on base plate 124. In one or more embodiments, jack 170 may be hydraulically or electrically actuated using hydraulic cylinders or electric linear actuators, respectively. In one or more embodiments, the hydraulic cylinders and electric linear actuators may be omitted, and jack 170 may be actuated using overhead cables. In one or more embodiments, jack 170 may include two or more piston cylinders, such as piston cylinders 172*a*, 172*b*. In one or more embodiments, jack 170 may include two sets of piston cylinders 172*a*, 172*b*, arranged in a square-shaped footprint surrounding longitudinal axis 114 of workover system 110. In any event, each of piston cylinders 172*a*, 172*b* includes a respective housing 174*a*, 174*b* and a respective piston rod 176*a*, 176*b*. Jack 170 may raise and lower traveling assembly 220 of workover system 110 by stroke length L1, wherein stroke length L1 of traveling assembly 220 corresponds to a stroke length of jack 170 effected by piston cylinders 172*a*, 172*b*. It will be appreciated that jack 170 may include any size and number of piston cylinders 172*a*, 172*b* necessary to provide stable and level operation and to accommodate design stroke length L1 of traveling assembly 220. In one or more embodiments, jack 170 may be rated to handle a weight twice an expected working load of workover system 110. For example, if a working load of 170,000 pounds is expected for an operation, jack 170 could be rated for 340,000 pounds. In one or more embodiments, stationary slips 150, 160 may be sized in accordance with the weight capacity of jack 170. For instance, if jack 170 is rated for 340,000 pounds, then stationary slips 150, 160 may be rated to handle 340,000 pounds. If greater clearance is needed to accommodate outer diameter D2 of production string 116, then stationary slips 150, 160 may have a greater weight capacity compared to jack 170 to accommodate the greater clearance. In one non-limiting example, in order to create adequate clearance for 9⅝ inch tubing, stationary slips 150, 160 may be rated for 600,000 pounds, whereas stationary slips 150, 160 creating adequate clearance for 7⅝ inch tubing may be rated for a lower weight capacity such as 340,000 pounds or 460,000 pounds. It will be appreciated that reference has been made herein to slips having standard sizes and weight capacities. However, slips having non-standard sizes and weight capacities may be used.

Stationary assembly 120 may further include a stationary BOP 180. In one or more embodiments, BOP 180 may be of a conventional type. Stationary BOP 180 is a dynamic BOP. In one or more embodiments, dynamic BOP 180 may be attached to base plate 124. In one or more embodiments, dynamic BOP 180 may be located below jack frame 122 and base plate 124 in cases where jack frame 122 does not support well pressure integrity through base plate 124. In such cases, base plate 124 may not include top and bottom ring grooves that would provide necessary pressure sealing.

In one or more embodiments, dynamic BOP 180 may include one or more sealing elements 182 for dynamic sealing. Sealing elements 182 may be standard elastomeric sealing elements known in the industry. The one or more dynamic sealing elements 182 are positioned within a bowl section (not shown) of a housing 184 of dynamic BOP 180. Housing 184 may include a first or lower flange 184*a* disposed for attachment to base plate 124. Housing 184 may enclose an actuation element (not shown) that may be hydraulically or electrically powered. In one or more embodiments, the actuation element is a hydraulically powered annular piston that pushes the one or more elements 182 against a cam surface (not shown) forcing the one or more elements 182 inward and into sealing engagement with a reciprocating riser 280 of traveling assembly 220. As used herein, dynamic sealing element refers to a sealing element through which a tubular, such as completion string 116, can dynamically slide while maintaining a seal between the tubular and the sealing element. Likewise, a dynamic annular BOP refers to a BOP through which a tubular, such as completion string 116, can slide while maintaining a seal around the tubular as it dynamically slides through the BOP.

Traveling assembly 220 of workover system 110 is operatively connected to stationary assembly 120 via jack 170. Upper ends of piston rods 176*a*, 176*b* may connect to a traveling assembly base plate 222. A traveling window 230 may be disposed on an upper surface of base plate 222. In one or more embodiments, traveling window 230 includes a roller guide arch 232 attached thereto for accommodating an off-axis approach of cable 118 toward production string 116 disposed along longitudinal axis 114. In one or more embodiments, cable 118 may be stored at ground level surface 104 on a reel (not shown). In one or more embodiments, cable 118 may run over the top of roller guide arch 232 directly or may be fed thereto by a large diameter guide wheel (not shown). In one or more embodiments, roller guide arch 232 moves with traveling assembly 220. In one or more other embodiments, roller guide arch 232 may be stationary and suspended from a crane or supported by workover system 110. During operation, cable 118 is brought adjacent and clamped to production string 116 using clamps 128 within traveling window 230.

In one or more embodiments, first work platform 130 moves vertically up and down with traveling window 230 providing personnel working on first work platform 130 access to production string 116 throughout an entire stroke length L1 of traveling window 230, allowing clamps 128 to be attached at any location along production string 116. In other embodiments, first work platform 130 is kept stationary providing personnel working on first work platform 130 with limited access to traveling window 230 such that each clamp 128 can only be installed when traveling window 230 has approached a bottom of a stroke. In one or more embodiments, safety may be improved by keeping first work platform 130 stationary such that personnel are not moving with traveling assembly 220.

Traveling assembly 220 may further include a first set of traveling slips 250 and a second set of traveling slips 260 disposed at an upper end of traveling window 230. In one embodiment, first set of traveling slips are heavy slips and second set of traveling slips are snub slips. Traveling heavy slips 250 can grip and hold production string 116 stationary relative to traveling assembly 220 in a pipe heavy condition, wherein a balance of forces on production string 116 is downward. Traveling snub slips 260 can grip and hold production string 116 stationary relative to traveling assembly 220 in a pipe light condition, wherein a balance of forces on production string 116 is upward. In one or more embodiments, traveling slips 250, 260 may have a weight capacity that ranges from about 150,000 pounds to about 600,000 pounds. More particularly, the weight capacity may range from about 150,000 pounds to about 460,000 pounds. In one non-limiting example, traveling slips 250, 260 may have a weight capacity of 340,000 pounds. In one or more embodiments, traveling slips 250, 260 may be sized in accordance with the weight capacity of jack 170 as described earlier for stationary slips 150, 160. In one or more embodiments, traveling slips 250, 260 may have inner diameter D1 greater than outer diameter D2 of production string 116. In one or more embodiments, in operation, there is a risk that pipe buckling may occur in an unsupported area of production string 116 between traveling snub slips 260 and stationary snub slips 160 or between traveling heavy slips 250 and stationary heavy slips 150. In one or more embodiments, a telescoping snubbing pipe guide may be positioned in the unsupported area to mitigate the risk of pipe buckling.

With continued reference to FIG. 4, traveling assembly 220 further includes traveling annular BOP 270. Traveling annular BOP 270 is a static annular BOP. In one or more embodiments, traveling annular BOP 270 is attached to base plate 222. Traveling annular BOP 270 may include one or more elastomeric, static sealing elements 272. The one or more elastomeric static sealing elements 272 may be configured to seal around any type of pipe or tubing known in the art including pipe or tubing having a circular or non-circular outer surface or any other irregular shape. The one or more elastomeric static sealing elements 272 may be softer or more deformable than conventional elements, such as the dynamic sealing element 182 described above, to enable conforming and sealing around irregular shapes. The one or more elastomeric static sealing elements 272 may be positioned within a bowl section (not shown) of a housing 274. Housing 274 may have upper and lower flanges for connecting traveling annular BOP 270 to adjoining flanges. Housing 274 may enclose an actuation element (not shown) that may be hydraulically or electrically powered. In one or more embodiments, the actuation element is a hydraulically powered annular piston that pushes the one or more elastomeric static sealing elements 272 against a cam surface (not shown) forcing the one or more elastomeric static sealing elements 272 inward and into sealing engagement with production string 116. In one non-limiting example, traveling annular BOP 270 may be a Regan Torus or Regan Type K annular BOP for sealing an annulus around production string 116 including cable 118 attached to an outside thereof. In one or more embodiments, traveling annular BOP 270 may be limited to static sealing only. In one or more embodiments, traveling annular BOP 270 may have a pressure rating from about 1000 psi to about 2000 psi. In one or more embodiments, traveling annular BOP 270 may have inner diameter D1 greater than outer diameter D2 of production string 116. In one non-limiting example, production string 116 may consist of 4½ inch tubing, and traveling annular BOP 270 may be a 7¹⁄₁₆ inch annular. It will be appreciated that in various embodiments, an annular having a different size may be used. However, in this example, the 7¹⁄₁₆ inch annular may represent the smallest standard size annular that could accommodate the 4½ inch tubing along with cable 118 and clamps 128 attached thereto. Of course, if production string 116 had a different size or cable 118 and clamps 128 had a lower or higher profile, then a smaller or larger standard size traveling annular BOP 270 could be used. As used herein, a static sealing element refers to a sealing element formed of elastomeric or similarly deformable, non-rigid material that can be deform or shaped to statically seal around irregularly shaped objects, such as completion string 116 with cable 118 attached thereto. Notably such sealing elements are not generally disposed to allow a tubular to slide relative to the sealing element and maintain a seal. The static seal is generally only maintained when the tubular is fixed relative to the static sealing element. Likewise, a static annular BOP refers to a BOP which seals most effectively around non-moving, static tubulars.

In one or more embodiments, traveling assembly 220 may include a purge gas flow cross assembly 216. In one or more embodiments, purge gas flow cross assembly 216 may be disposed above dynamic BOP 180 and below traveling annular BOP 270 in fluid communication with annulus 290. In one or more embodiments, purge gas flow cross assembly 216 may connect to traveling annular BOP 270 and move with traveling assembly 220. Purge gas flow cross assembly 216 may include a first or inlet port 216*a* and a second or inlet/outlet port 216*b*. To control fluid communication through first port 216*a* and second port 216*b*, purge gas flow cross assembly 216 may further include first and second valves (not shown), which may be operated using a control system.

Traveling assembly 220 further includes a reciprocating riser 280 extending below and in fluid communication with traveling annular BOP 270. In one or more embodiments, purge gas flow cross assembly 216 may be connected between reciprocating riser 280 and traveling annular BOP 270. In any event, reciprocating riser 280 and traveling BOP 270 are fixed relative to one another and reciprocate in unison as described herein. Reciprocating riser 280 includes an inner surface 280*a* having inner diameter D3 and an outer surface 280*b* having outer diameter D4. Production string 116 and cable 118 may be disposed within reciprocating riser 280. Inner diameter D3 of reciprocating riser 280 may be greater than outer diameter D2 of production string 116. Reciprocating riser 280 may be disposed inside dynamic BOP 180 forming a dynamic seal between the one or more elements 182 of dynamic BOP 180 and outer surface 280*b* of reciprocating riser 280, thereby permitting a seal to be maintained as reciprocating riser 280 is moved axially through dynamic BOP 180. It will be appreciated that in various embodiments, outer surface 280*b* may be machined smooth and/or polished to improve sealing. In one or more embodiments, outer surface 280*b* may be lubricated to reduce friction on the reciprocating seal. Dynamic BOP 180 may be sized to have inner diameter D1 greater than outer diameter D4 of reciprocating riser 280 to accommodate displacement of reciprocating riser 280 therein. Dynamic BOP 180 may have a larger clearance than a lower annular BOP 200 (to be described later) and traveling annular BOP 270 to accommodate reciprocating riser 280 having a larger outer diameter D4 compared to outer diameter D2 of production string 116. In one or more embodiments, dynamic BOP 180 may have a pressure rating from about 1000 psi to about 2000 psi. In one or more embodiments, a variable hydraulic control or pressure regulator may be used to limit an actuation pressure of dynamic BOP 180 to maintain the one or more elements 182 in sealing contact with reciprocating riser 280 without over pressurizing the reciprocating seal. For example, if only 600 psi is needed to maintain the reciprocating seal, then applying greater than 600 psi, or more particularly, applying around about 1500 psi to about 2000 psi would wear out the one or more elements 182 at a much faster rate. In one non-limiting example, production string 116 may consist of 4½ inch tubing, and traveling annular BOP 270 may be a 7¹⁄₁₆ inch annular. In that case, reciprocating riser 280 may have a 7¹⁄₁₆ inch inner diameter D3 and an outer diameter D4 around about 8+ inches depending on pipe specifications. Then it will be appreciated that to accommodate reciprocating riser 280, dynamic BOP 180 may be a next standard size 11 inch annular, one size larger than lower annular BOP 200 and traveling annular BOP 270. Of course, if traveling annular BOP 270 were smaller or larger, then a smaller (7¹⁄₁₆ inch) or larger (13⅝ or 18 inch) standard size dynamic BOP 180 could be used.

Thus, the one or more elements 182 of dynamic BOP 180 may form a dynamic seal with outside surface 280*b* of reciprocating riser 280. Reciprocating riser 280 and dynamic BOP 180 may move vertically or rotate relative to each other while outer surface 280*b* of reciprocating riser 280 remains in sealing engagement with the one or more elements 182. In one or more embodiments, polishing and/or lubricating outer surface 280*b* of reciprocating riser 280 may improve sealing with and may increase the lifespan of the one or more elements 182. The dynamic seal may provide well pressure integrity inside reciprocating riser 280 between dynamic BOP 180 and traveling annular BOP 270. Traveling annular BOP 270 and reciprocating riser 280 may travel vertically up and down with traveling assembly 220 including piston rods 176*a*, 176*b*, base plate 222, traveling window 230, traveling heavy slips 250, and traveling snub slips 260. In this way, traveling annular BOP 270, reciprocating riser 280, and dynamic BOP 180 form a sealed telescoping assembly effectively functioning as a wellhead moving with traveling assembly 220. In one or more embodiments, traveling assembly 220 may reciprocate below a level of second work platform 132, wherein traveling heavy slips 250 and traveling snub slips 260 are disposed below stationary heavy slips 150 and stationary snub slips 160. This arrangement may represent an opposite orientation compared to a traditional hydraulic workover or snubbing unit.

Figure 5:
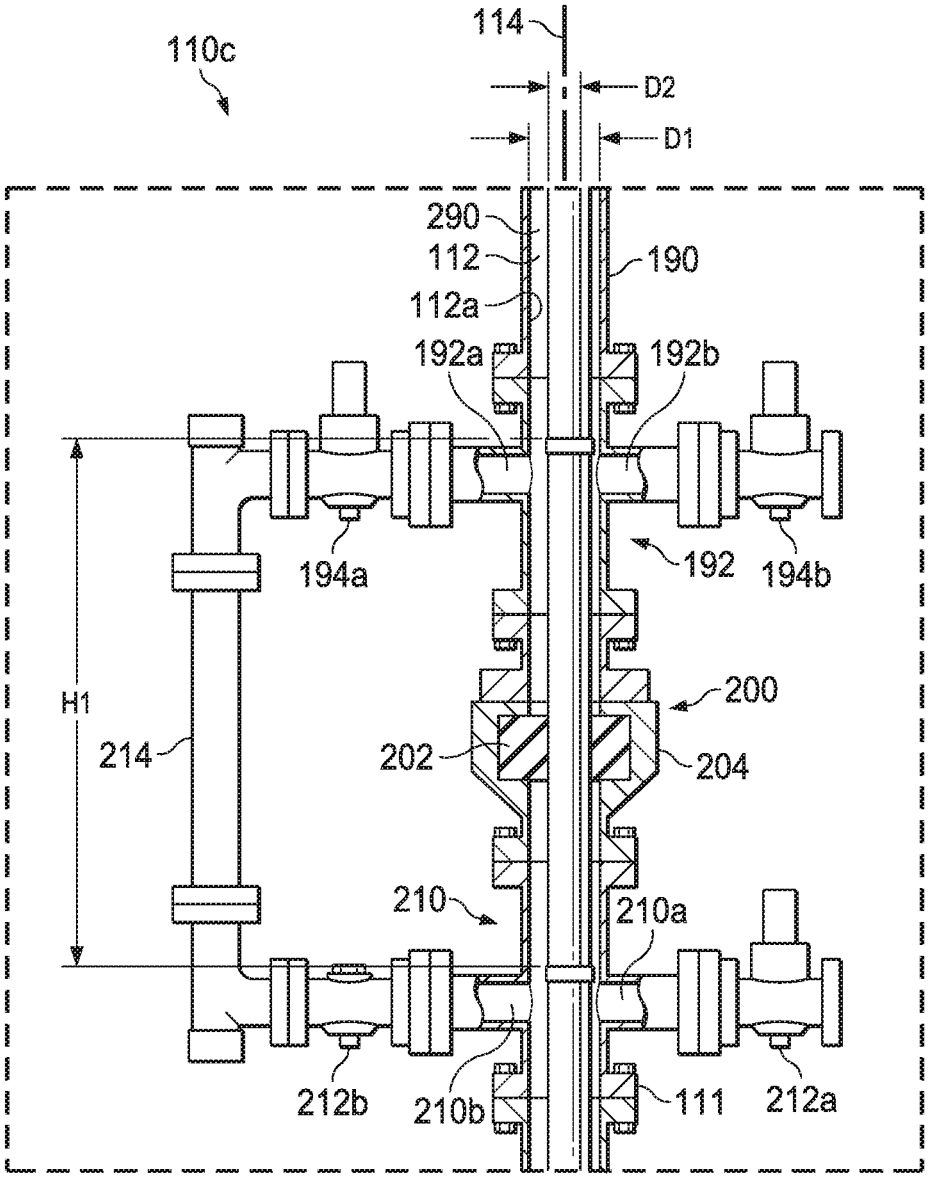
FIG. 5 is a close-up front elevation view of a lower portion of the hydraulic workover unit of FIG. 1.

FIG. 5 is a close-up front elevation view of a lower portion of the hydraulic workover unit of FIG. 1, and in particular, illustrates lower portion 110*c* of workover system 110 in more detail. Below base plate 124, stationary assembly 120 may further include an API spool extension 190 to accommodate internal displacement of reciprocating riser 280 of traveling assembly 220, to be described later. In one or more embodiments, API spool extension 190 may have inner diameter D1 greater than outer diameter D2 of production string 116. An upper flow cross assembly 192 may be located below API spool extension 190. In one or more embodiments, upper flow cross assembly 192 may have inner diameter D1 greater than outer diameter D2 of production string 116. Upper flow cross assembly 192 includes an equalization port 192*a* and a bleed off port 192*b*. To control fluid communication through equalization port 192*a* and bleed off port 192*b*, upper flow cross assembly 192 may further include an equalization valve 194*a* and a bleed off valve 194*b*, respectively. Upper flow cross assembly 192 enables equalization to or bleed off of wellbore pressure in an annulus 290 above a lower annular BOP 200. Equalization valve 194*a* and bleed off valve 194*b* may be operated using a control system to facilitate movement of production string 116 into and out of wellbore 102 under pressure.

Lower annular BOP 200 may be positioned below upper flow cross assembly 192. Lower annular BOP 200 is a static BOP and may include one or more elastomeric static sealing elements 202. The one or more elastomeric static sealing elements 202 may be configured to seal around any type of pipe or tubing known in the art including pipe or tubing having a circular or non-circular outer surface or any other irregular shape. The one or more embodiments, elastomeric static sealing elements 202 may be softer than conventional elements to enable conforming and sealing around irregular shapes. The one or more elastomeric elements 202 may be positioned within a bowl section (not shown) of a housing 204. Housing 204 may have upper and lower flanges for connecting lower annular BOP 200 to adjoining flanges. Housing 204 may enclose an actuation element (not shown) that may be hydraulically or electrically powered. In one or more embodiments, the actuation element is a single acting, hydraulically powered, annular piston that receives a hydraulic pressure through an inlet port, moves upward, and compresses the one or more elastomeric elements 202 against a cam surface (not shown) forcing the one or more elastomeric elements 202 inward and into sealing engagement with production string 116. The actuation element may be reversed and the one or more elastomeric elements 202 opened by venting the hydraulic pressure. A cycle open time may vary due to ambient temperature. In one or more embodiments, a dual acting design, providing power open and power close, may be used to positively retract the annular piston. In one non-limiting example, lower annular BOP 200 may be a Regan Torus or Regan Type K annular BOP for sealing an annulus around production string 116. In one or more embodiments, lower annular BOP 200 may be limited to static sealing only. In one or more embodiments, lower annular BOP 200 may have a pressure rating from about 1000 psi to about 2000 psi. In one non-limiting example, production string 116 may consist of 4½ inch tubing, and lower annular BOP 200 may be a 7⁄16 inch annular. It will be appreciated that in various embodiments, an annular having a different size may be used. However, in this example, the 7⁄16 inch annular represents the smallest standard size annular that could accommodate the 4½ inch tubing. Of course, if production string 116 had a different size, then a smaller or larger standard size lower annular BOP 200 could be used. In one or more embodiments, lower annular BOP 200 may have inner diameter D1 greater than outer diameter D2 of production string 116.

In one or more embodiments, during operation, an equalization step may be required because lower annular BOP 200 may not open with a pressure differential across lower annular BOP 200 caused by higher wellbore pressure below lower annular BOP 200 than in annulus 290 above lower annular BOP 200. In one or more embodiments, an equalization gas or liquid having a pressure high enough to counteract wellbore pressure below lower annular BOP 200 may be fed to equalization port 192*a*. In one or more embodiments, injecting gas for this purpose may be preferred since introducing non-gaseous fluids into wellbore 102 may be undesirable. In one or more embodiments, the equalization gas may include, without limitation well fluid or nitrogen (N2). In the case of well fluid, a lower flow cross assembly 210 may be installed below lower annular BOP 200. Lower flow cross assembly 210 may include a first or inlet port 210*a* and a second or outlet port 210*b*. To control fluid communication through first port 210*a* and second port 210*b*, lower flow cross assembly 210 further includes a first or inlet valve 212*a* and a second or outlet valve 212*b*, respectively. First valve 212*a* and second valve 212*b* may be remotely operated using a control system to facilitate the equalization step. In one or more embodiments, second valve 212*b* may be opened to route well fluid to equalization port 192*a* via a flow loop 214. In one or more embodiments, N2 may be injected into annulus 290 via equalization port 192*a* using external piping, separate from lower flow cross assembly 210 or flow loop 214, connected directly to equalization port 192*a* or first valve 194*a*. In one or more embodiments, N2 may be injected using an additional T-junction on flow loop 214.

In one or more embodiments, first flange 111 of workover system 110 disposed below lower flow cross assembly 210 may be connected to one or more annular and ram-type BOPs, choke/kill lines, choke/kill flow crosses, and other valve and fittings (not shown) located adjacent to or generally disposed above wellhead 106 to provide secondary and tertiary safety and shear functions and annulus access for kill fluid circulation if so required based on contingency planning.

In one or more embodiments, during operation, gas, such as natural gas or sweet gas, may be disposed in annulus 290 above lower annular BOP 200. In this case, the gas may be vented to the atmosphere. In one or more embodiments, the gas may include hydrogen sulfide ($H_2S$), which can be purged with N2 by equalizing and bleeding off with N2, thus limiting the presence of $H_2S$ above lower annular BOP 200. Additional valving and piping may connect bleed off port 192*b* to a flare pit for gas or a liquid pit in the case of liquid and gas (not shown). In operation, according to one or more embodiments, a purge gas, such as N2, may be flowed into purge gas flow cross assembly 216 through either first port 216*a* or second port 216*b*, down through the annulus 290, and out through bleed off port 192*b* in order to expel $H_2S$ from within annulus 290.

In one or more embodiments, annulus 290 may be defined at a top end by the one or more elastomeric elements 272 of traveling annular BOP 270; at a bottom end by the one or more elastomeric elements 202 of lower annular BOP 200; on an outside surface by housing 274 of traveling annular BOP 270, purge gas flow cross assembly 216, reciprocating riser 280, the one or more elements 182 and housing 184 of dynamic BOP 180, extension spool 190, upper flow cross assembly 192, and housing 204 of lower annular BOP 200; and on an inside surface by production string 116.

Figure 6:
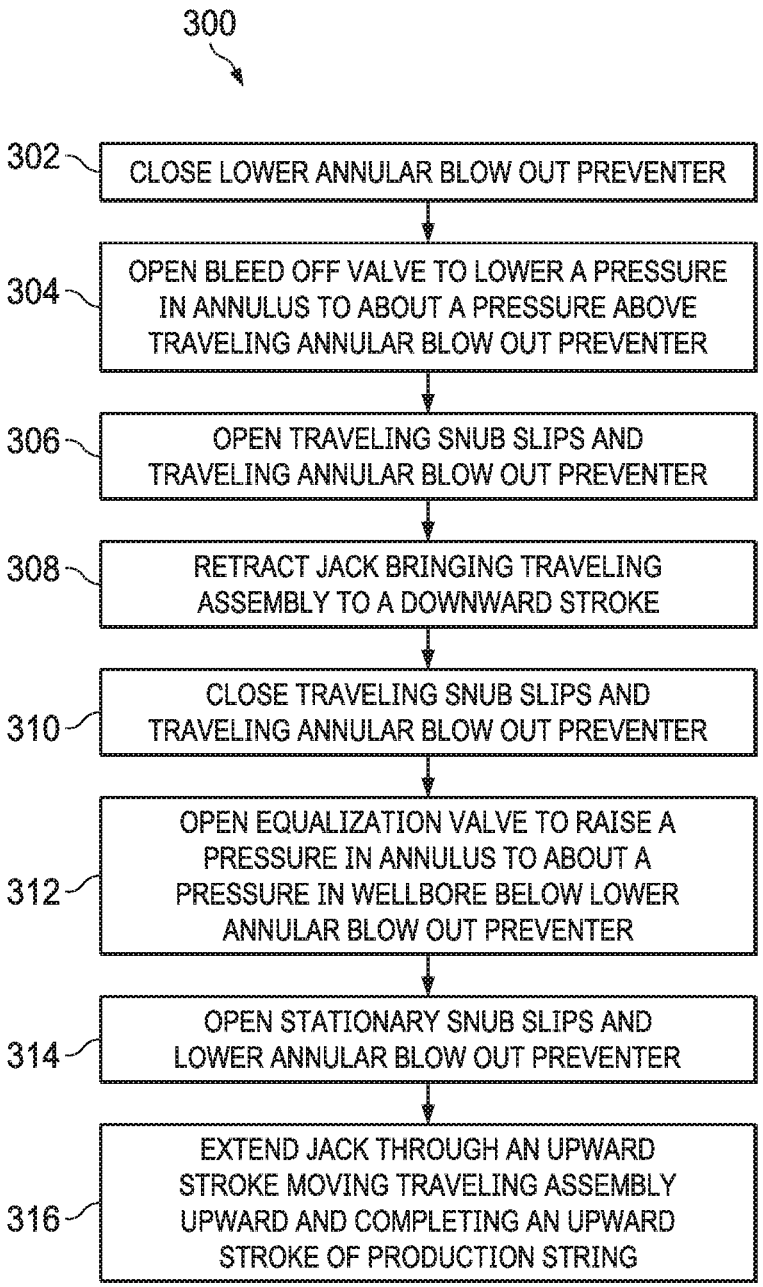
FIG. 6 is a flowchart outlining a first method of using a hydraulic workover unit in accordance with the teachings herein.

FIG. 6 is a flowchart outlining a first method of using a hydraulic workover unit. Specifically, shown is a method 300 of using workover system 110 illustrated with reference to FIGS. 1-5. More particularly, method 300 describes tripping out production string 116 under pressure in a pipe light condition starting from an initial position, such as illustrated in FIG. 1, of workover system 110. In this initial position for tripping out, workover system 110 is shown extended, such as at the top or end of an upstroke of production string 116, where movement of traveling assembly 220 has only just stopped. In the initial position or "extended" position, hydraulic cylinders 172*a*, 172*b* are extended bringing traveling assembly 220 to the top of upward stroke, where traveling annular BOP 270 is still in a sealingly closed configuration around the production string, while fixed annular BOP 200 remains in an open configuration about the production string to allow the production string to move upward therethrough. Traveling snub slips 260 may be in a closed configuration to grip production string 116. Finally, equalization valve 194*a* and bleed off valve 194*b* may be closed.

Continuing from the initial position, at step 302, with traveling annular BOP 270 remaining in a closed configuration, lower annular BOP 200 is now activated to a closed configuration to sealingly engage production string 116 so as to contain wellbore pressure within wellbore 102 below lower annular BOP 200. Stationary snub slips 160 may be set in order to support production string 116 during this stage of the operation. In one or more embodiments, stationary snub slips 160 may be set before activating lower annular BOP 200 so as to prevent relative movement between production string 116 and lower annular BOP 200. At optional step 304, because gas may be trapped in annulus 290 between lower annular BOP 200 and traveling annular BOP 270, bleed off valve 194*b* may be opened to lower the pressure within annulus 290.

In any event, since lower BOP 200 is now in a closed configuration, in step 306, traveling annular BOP 270 may be activated to an opened configuration before progressing farther. In this open configuration, traveling BOP 270 is sealingly disengaged from the production string to allow the traveling BOP 270 to be moved downward relative to the production string, which is temporarily suspended by stationary snub slips 160. Thus, at this point, production string 116 is suspended by stationary snub slips 160 while traveling snub slips 260 and traveling annular BOP 270 are both in an open configuration. In one or more embodiments, traveling snub slips 260 may be opened after activating traveling annular BOP 270 so as to prevent relative movement between production string 116 and traveling annular BOP 270.

At step 308, jack 170 is actuated to urge it from the initial extended position to a retracted position, bringing traveling assembly 220 to the bottom of a downward stroke. In one or more embodiments, the bottom of a downward stroke may be about one foot above a retraction stop. At this stage, workover system 110 is in a retracted position, traveling assembly 220 having moved axially downward by stroke length L1. As jack 170 is moved to its retracted position, reciprocating riser 280 slides downward through dynamic BOP 180. In this regard, in some embodiments, when jack 170 is in the extended position, a bottom end 280*c* of reciprocating riser 280 may be disposed in housing 184 of dynamic BOP 180. After jack 170 has moved to the retracted position, reciprocating riser 280 may extend further downward through spool extension 190 and into flow cross assembly 192. In the retracted position, bottom end 280*c* of reciprocating riser 280 may be disposed in flow cross assembly 192. It should be noted that in one or more embodiments, throughout any stroke of jack 170, reciprocating riser 280 remains in dynamic sealing engagement with dynamic BOP 180 to ensure annulus 290 is always contained. Spool extension 190 and flow cross assembly 192 may be sized wherein inner diameter D1 of each is greater than outer diameter D4 of reciprocating riser 280 to accommodate displacement of reciprocating riser 280 therein.

At step 310, with jack 170 at the bottom of its stroke, traveling annular BOP 270 may now be actuated to a closed configuration to sealingly engage the production string. In one or more embodiments, traveling snub slips 260 may also be actuated to a closed configuration around the production string so as to engage the production string for supporting the weight of the production string. In one or more embodiments, traveling snub slips 260 may be set before activating traveling annular BOP 270 so as to prevent relative movement between production string 116 and traveling annular BOP 270.

At optional step 312, with both traveling annular BOP 270 and lower annular BOP 200 in closed configurations and sealingly engaging the production string, equalization valve 194*a* is opened to raise a pressure in annulus 290 to about wellbore pressure below lower annular BOP 200. In one or more embodiments, step 312 may further include opening second valve 212*b* of lower flow cross assembly 210 and routing fluid from wellbore 102 to equalization valve 194*a* via flow loop 214. In one or more other embodiments, step 312 may further include injecting N2 into annulus 290 via equalization port 192*a*, as described above.

At step 314, with wellbore pressure contained below traveling BOP 270 by virtue of BOP 270 being in a closed configuration around the production string, lower annular BOP 200 is actuated to an opened configuration so as to sealingly disengage lower BOP 200 from the production string, leaving only traveling BOP 270 sealingly engaged with the production string. In one or more embodiments, stationary snub slips 160 may also be released so that only traveling snub slips 260 are supporting the production string. In one or more embodiments, jack 170 may be retracted several inches to allow stationary snub slips 160 to open. In one or more embodiments, stationary snub slips 160 may be opened after activating lower annular BOP 200 so as to prevent relative movement between production string 116 and lower annular BOP 200.

At step 316, jack 170 is activated to extended jack 170 through an upward stroke, moving traveling assembly 220 upward and completing an upward stroke of production string 116, thereby lifting production string 116 out of wellbore 102. In one or more embodiments, the upward stroke may be about one foot below an extension stop. At this stage, workover system 110 has returned to the original beginning or "extended" position having traveled upward by stroke length L1. To continue tripping out, method 300 is repeated by returning to step 302 and progressing again through the steps described above.

Figure 7:
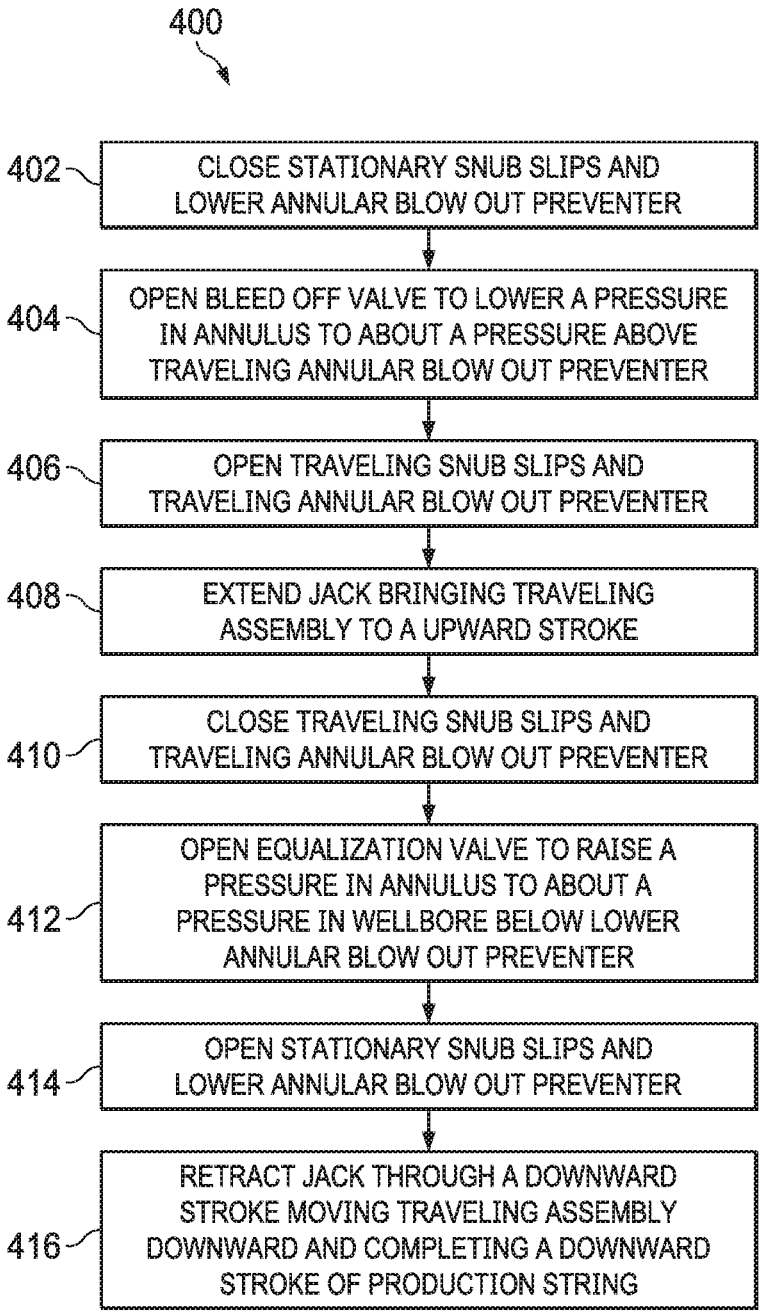
FIG. 7 is a flowchart outlining a second method of using a hydraulic workover unit in accordance with the teachings herein.

Turning to FIG. 7, a method 400 of using workover system 110 is illustrated with reference to FIGS. 1-5. More particularly, method 400 describes tripping in a production string under pressure in a pipe light condition. The following lists the changes needed to adapt method 300 to method 400. At step 308, jack 170 is moved to the extended position bringing traveling assembly 220 to a desired upward stroke position, and at step 316, jack 170 is retracted in a downward stroke, moving traveling assembly 220 downward and completing a downward stroke of production string 116. Otherwise, the steps of method 300 are taken in the same sequence as before, and to continue tripping in the method is repeated by returning to step 302 as before.

FIG. 7 is a flowchart outlining a second method of using a hydraulic workover unit. Specifically, shown is method 400 of tripping in a production string under pressure in a pipe light condition starting from the retracted position of workover system 110, wherein a downstroke of production string 116 has just been completed and movement of traveling assembly 220 has only just stopped. Thus, in an initial position for tripping in, hydraulic cylinders 172*a*, 172*b* are in a "retracted" position such that traveling assembly 220 is at the bottom of a downward stroke. At this point, traveling annular BOP 270 is in a closed configuration, sealingly engaging the production string while lower annular BOP 200 is in an open configuration so as to be sealingly disengaged from the production string. Moreover, at this initial position, traveling snub slips 260 are in a closed configuration, thereby gripping and supporting production string 116. In one or more embodiments, equalization valve 194*a* and bleed off valve 194*b* may be closed.

Continuing from the initial trip in position described above, at step 402, lower annular BOP 200 is actuated from an open to a closed position, thereby sealingly engaging production string 116. In one or more embodiments, stationary snub slips 160 may likewise be actuated to a closed position so as to grip production string 116. In one or more embodiments, stationary snub slips 160 may be set before activating lower annular BOP 200 so as to prevent relative movement between production string 116 and lower annular BOP 200.

At optional step 404, with both traveling annular BOP 270 and lower annular BOP 200 in a closed configuration, bleed off valve 194*b* may be opened to lower the pressure in annulus 290 adjacent dynamic BOP 180 to the pressure that is annulus 290 above traveling annular BOP 270.

At step 406, with the wellbore pressure contained below lower annular BOP 200, traveling annular BOP 270 actuated to an open configuration so as to disengage the production string 116, leaving only lower annular BOP 200 sealingly engaged with the production sting 116. In one or more embodiments, stationary snub slips 160 are also actuated to a closed configuration so as to grip production string 116. In one or more embodiments, traveling snub slips 260 may be released from gripping engagement with production string 116. In one or more embodiments, jack 170 may be extended several inches to allow traveling snub slips 260 to be actuated to an open configuration. In one or more embodiments, traveling snub slips 260 may be opened after activating traveling annular BOP 270 so as to prevent relative movement between production string 116 and traveling annular BOP 270.

At step 408, jack 170 is activated to extended jack 170 through an upward stroke, moving traveling assembly 220 upward and completing an upward stroke. The upward stroke may top out about one foot below the extension stop. At this stage, workover system 110 is in the extended position having traveled upward by stroke length L1. It will be appreciated that at this point, stationary snub slips 160 are supporting production string 116 while lower annular BOP 200 is sealingly engaging production string 116. Moreover, because traveling annular BOP 270 is disengaged from production string 116 (as are traveling snub slips 260), then traveling assembly 220 can be moved upward relative to production string 116 through the upward stroke of jack 170. As such, traveling annular BOP 270 moves axially relative to production string 116.

At step 410, with traveling assembly 220 extended to the top of the upward stroke of jack 170, traveling BOP 270 is actuated to a closed configuration so as to sealingly engage production string 116. In one or more embodiments, traveling snub slips 260 may likewise be actuated to a closed configuration in order to grip production string 116. In one or more embodiments, traveling snub slips 260 may be set before activating traveling annular BOP 270 so as to prevent relative movement between production string 116 and traveling annular BOP 270.

It will be appreciated at this point that both traveling BOP 270 and lower BOP 200 are sealingly engaged with production string 116. Thus, at optional step 412, equalization valve 194*a* may be opened to raise the pressure in the annulus 290 adjacent dynamic BOP 170 to a pressure that is approximately the same as the wellbore pressure below lower annular BOP 200.

At step 414, with wellbore pressure contained below traveling annular BOP 270, lower annular BOP 200 may be actuated to an open configuration, thereby sealingly disengaging lower annular BOP 200 from the production string 116. In one or more embodiments, stationary snub slips 160 may also be actuated to an open configuration, thereby releasing them from gripping engagement with production string 116 leaving only traveling snub slips 260 to support the weight of production string 116. In one or more embodiments, stationary snub slips 160 may be opened after activating lower annular BOP 200 so as to prevent relative movement between production string 116 and lower annular BOP 200.

At step 416, with traveling BOP 270 sealingly engaging production string 116 and traveling snub slips 260 supporting production string 116, traveling assembly 220 may be lowered towards wellhead 106 by actuating jack 170 through a downward stroke, moving traveling assembly 220 downward and thus lowering production string 116 into wellbore 102. The downward stroke may be about one foot above the extension stop. At this stage, workover system 110 has returned to the retracted position having traveled downward by stroke length L1. To continue tripping in, method 400 is repeated by returning to step 402.

In one or more embodiments, method 400 may be used for snubbing production string 116 having a packer (not shown) and tailpipe (not shown) disposed thereon rather than having cable 118 attached thereto. The tailpipe may be disposed below the packer. In one non-limiting example, the packer may be a retrievable hydraulic-set packer having a bidirectional slip system and a packing element, and the tailpipe may include a temporary plugging device. Once the packer is positioned in wellbore 102, a pressure differential is created by pressuring up against a temporary plugging device (not shown) until a shear release pressure is reached generating enough force to set the slips and expand the packing element to seal off an annulus in wellbore 102. Using method 400 in conjunction with workover system 110 may eliminate compression loading on the packer during snubbing into wellbore 102. In this case, production string 116 may have a substantially circular outer surface 116*a* instead of the non-circular or other irregularly shaped outer surface 116*a* of production string 116 having cable 118 attached thereto. Therefore, the one or more elastomeric elements 202, 272 configured for sealing the non-circular or other irregularly shaped outer surface 116*a* may be unnecessary and surface pressures may exceed 2000 psi.

To adapt methods 300, 400 to a pipe heavy condition, stationary heavy slips 150 and traveling heavy slips 250 are substituted for stationary snub slips 160 and traveling snub slips 260 in each instance. A change in slip utilization is needed because conventional slips only grip production string 116 in a single direction, i.e., heavy slips resist downward force and snub slips resist upward force, as described earlier. In one or more embodiments, rather than using conventional slips, a slip bowl load transfer system may be used to engage both heavy and snub slips on production string 116 simultaneously. Using workover system 110, snub loads based on a total cross-sectional area of reciprocating riser 280 may exceed snub loads experienced by a conventional workover unit based on a net cross-sectional area of production string 116 and cable 118. Higher snub loads may greatly increase potential loading on reciprocating jack 170 relative to conventional snubbing operations. Given a relatively large total cross-sectional area of reciprocating riser 280, a weight of production string 116 may cycle between heavy and light load directions. A pipe heavy load may reverse to pipe light when reciprocating riser 280 is equalized (pressured up) at steps 312, 412. Conversely, a pipe light load may reverse to pipe heavy when reciprocating riser 280 is bled off (depressurized) at steps 304, 404. Various load transfer technology may resist loading from production string 116 automatically in both directions, eliminating risk of operator error and enhancing safety.

In operation of workover system 110, it may be important that production string 116 does not move relative to lower annular BOP 200 or traveling annular BOP 270 when either annular is closed. Relative movement may occur if jack 170 begins to move production string 116 before the respective BOP is opened. Sliding production string 116 including cable 118 and clamps 128 through one or more engaged elastomeric elements 202, 272 of lower annular BOP 200 and traveling annular BOP 270, respectively, may damage cable 118 and clamps 128. To prevent inadvertent movement of jack 170 and production string 116 an interlock system may be used to assure correct logic between open/close of slips 150, 160, 250, 260, open/close of lower annular BOP 200 and traveling annular BOP 270, and control of jack 170.

In one non-limiting example, referring to steps 306 and 308 of method 300, the interlock system may prevent jack 170 from being retracted at step 308 until receiving a signal that traveling annular BOP 270 has opened at step 306. In the same way, the interlock system may prevent jack 170 from being extended at step 316 until receiving a signal that lower annular BOP 200 has opened at step 314. It will be appreciated that the interlock system may be any hydraulic, pneumatic, or electrical interlock system known in the art.

In one or more embodiments, method 300 may be modified by separating each of steps 310, 314 into two separate steps, wherein each separate step is independently linked to the interlock system. Likewise, method 400 may be modified by separating each of steps 410, 414 into two separate steps, wherein each separate step is independently linked to the interlock system.

In one or more embodiments, the interlock system may also function as a grip interlock to prevent inadvertent release of production string 116. In one non-limiting example, referring to steps 302 and 306 of method 300, the grip interlock may prevent traveling snub slips 260 from being opened at step 306 until receiving a signal that stationary snub slips 160 have closed at step 302 and are supporting production string 116. In the same way, the grip interlock may prevent stationary snub slips 160 from being opened at step 314 until receiving a signal that traveling snub slips 260 have closed at step 310 and are supporting production string 116. A signal indicating closed slips may be a hydraulic, pneumatic, or electrical signal. In one or more embodiments, slips 150, 160, 250, 260 may be hydraulically actuated using one or more hydraulic cylinders. An increase in hydraulic pressure or fluid flow in a grip direction of the one or more hydraulic cylinders may indicate gripping. Likewise, an increase in hydraulic pressure or fluid flow in a release direction of the one or more hydraulic cylinders may indicate non-gripping. In one or more embodiments, the position of the slips may be monitored using one or more proximity or position sensors to detect actuation to a gripping or non-gripping position.

In one or more embodiments, a direct indication of slips 150, 160, 250, 260 supporting production string 116 may be provided by a load cell positioned on slips 150, 160, 250, 260. An increase in load above a threshold value may indicate supporting production string 116 and a decrease in load below the threshold value may indicate non-support of production string 116.

Various advantages of keeping the well alive throughout the ESP completion operation include maintaining the current production rate of the well; preventing skin damage to the producing formation; reducing the cost of ESP workover by eliminating a need to transport, store, and pump kill fluids into the wellbore for well control; and reducing a chance of formation damage. Particularly, embodiments of the hydraulic workover unit include a stationary assembly including a dynamic annular and a traveling assembly including a reciprocating riser, wherein the reciprocating riser moves in sealing engagement with the dynamic annular for sealing a pressure in the wellbore as the traveling assembly moves the production string. In one or more embodiments, the hydraulic workover unit enables dynamic movement and pressure control during snubbing at well surface pressures up to about 2,000 psi; provides dynamic sealing during insertion and/or removal of the production string from the wellbore; provides load control in both pipe heavy and pipe light conditions; and enables safe operation while performing a live well workover.

Thus, a workover unit for moving a production string through a wellbore has been described. In one or more embodiments, the workover unit may include a stationary assembly having a dynamic BOP; and a traveling assembly movable relative to the stationary assembly between a first extended position and a second retracted position, the traveling assembly having a reciprocating riser with a riser diameter, wherein the reciprocating riser extends through the dynamic BOP so as to be sealingly engaged therewith in each of the fully extended and fully retracted positions of the traveling assembly. In other embodiments, the workover unit may include a dynamic BOP supported on a workover frame having an upper end and a lower end; a first static annular BOP axially aligned with the dynamic BOP and positioned between dynamic BOP and the upper end of the workover frame; and a second static annular BOP axially aligned with the dynamic BOP and positioned below the dynamic BOP.

For any of the foregoing embodiments, the workover unit may include any one of the following elements, alone or in combination with each other:

- Dynamic BOP is an annular BOP.
- Dynamic BOP is a ram BOP.
- The dynamic BOP comprises a solid elastomeric element.
- The static annular BOP comprises an inflatable seal element.
- The static annular BOP comprises an expandable seal element.
- The stationary assembly further comprises a lower annular BOP.
- The traveling assembly further comprises a traveling annular BOP from which the reciprocating riser extends.
- The traveling assembly further comprises one or more traveling slips.
- An actuation mechanism for reciprocating traveling assembly relative to stationary assembly.
- The stationary assembly further comprises one or more stationary slips.
- The traveling assembly further comprises a traveling annular BOP from which the reciprocating riser extends and wherein the stationary assembly further comprises a lower annular BOP, the traveling annular BOP and lower annular BOP being static BOPs.
- A tubular extending between the dynamic BOP and the lower annular BOP, wherein the tubular has a tubular diameter that is larger than the riser diameter of the reciprocating riser.
- The traveling annular BOP is a static annular BOP and includes one or more expandable elastomeric seal elements.
- A workover unit for moving a production string through a wellbore comprising:
- The lower end of the workover frame comprises a stationary assembly to which the dynamic BOP is attached and the upper end of the workover frame comprises a traveling assembly to which the first static annular BOP is attached, wherein the traveling assembly is axially movable relative to the stationary assembly.

The traveling assembly further comprises traveling slips supported on the workover frame between the first static annular BOP and the upper end of the workover frame.

The stationary assembly further comprises a lower annular configured to seal around the production string when the traveling assembly is moved relative to the production string.

The traveling assembly further comprises traveling slips configured to grip the production string during the lowering.

A cross-over assembly adjacent the lower static annular BOP.

Relatedly, a method of snubbing a production string using a workover unit has been described. Embodiments of the snubbing method may include forming a first seal between the production string and a traveling assembly; forming a second seal between a reciprocating riser of the traveling assembly and a dynamic annular of a stationary assembly; and lowering the traveling assembly relative to the stationary assembly to snub the production string into the wellbore, wherein the first and second seals are formed prior to lowering the traveling assembly. In other embodiments, the snubbing method includes positioning a production string in a riser; activating a first static annular BOP adjacent the production string; activating a second static annular BOP adjacent the production string; and moving the pipe string and riser in conjunction with one another by passing the riser through a dynamic BOP.

For the foregoing embodiments, the method may include any one of the following steps, alone or in combination with each other:

Forming the first seal comprises closing a traveling annular on the production string.

Forming the second seal comprises closing the dynamic annular on the reciprocating riser.

Lowering the traveling assembly relative to the stationary assembly comprises retracting a reciprocating jack.

Closing traveling snub slips on the production string to grip the production string prior to lowering the traveling assembly relative to the stationary assembly.

Opening stationary snub slips after the traveling snub slips are closed.

Opening a lower annular after the traveling annular is closed.

Opening an equalization port prior to opening the lower annular.

Supporting the production string at a location above the first static annular BOP; activating a first static annular BOP adjacent the production string comprises engaging the production string with the first static annular BOP; activating a second static annular BOP adjacent the production string comprises disengaging the second static annular BOP from the production string; and further comprising lowering the production string into a wellbore.

Supporting the production string at a location above the first static annular BOP; activating a second static annular BOP adjacent the production string comprises engaging the production string with the second static annular BOP; activating a first static annular BOP adjacent the production string comprises disengaging the first static annular BOP from the production string; and further comprising raising the production string from a wellbore.

Raising the production string from a wellbore comprises extending a reciprocating jack and moving the riser upward through the dynamic annular riser.

Lowering the production string into a wellbore comprises retracing a reciprocating jack and moving the riser downward through the dynamic annular riser Engaging the production string with the first static annular BOP comprises inflating a first static sealing element; and wherein disengaging the second static annular BOP from the production string comprises deflating a second static sealing element.

Disengaging the first static annular BOP from the production string comprises deflating a first static sealing element; and wherein engaging the second static annular BOP with the production string comprises deflating a second static sealing element.

Opening an equalization port prior to disengaging the second static annular BOP.

Engaging the production string with the static annular BOP comprises inflating a static sealing element.

Disengaging the production string with the static annular BOP comprises deflating a static sealing element.

Supporting the production string at a location above the first static annular BOP Activating a first static annular BOP adjacent the production string comprises engaging the production string with the first static annular BOP.

Activating a first static annular BOP adjacent the production string comprises disengaging the first static annular BOP from the production string.

Activating a second static annular BOP adjacent the production string comprises engaging the production string with the second static annular BOP.

Activating a second static annular BOP adjacent the production string comprises disengaging the second static annular BOP from the production string.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

The invention claimed is:

1. A workover unit for moving a production string through a wellbore comprising:

a stationary assembly having a dynamic BOP and a lower annular BOP positioned below the dynamic BOP; and a traveling assembly movable relative to the stationary assembly between an extended position and a retracted position, the traveling assembly having a reciprocating riser with a riser diameter, wherein the reciprocating riser extends through the dynamic BOP so as to be sealingly engaged therewith in each of a fully extended and a fully retracted position of the traveling assembly;

an equalization port above the lower annular BOP in fluid communication with the reciprocating riser; and a flow loop coupled to the equalization port, the flow loop in fluid communication with a source of an equalization fluid.

2. The workover unit of claim 1, wherein the traveling assembly further comprises a traveling annular BOP from which the reciprocating riser extends.

3. The workover unit of claim 2, wherein the traveling annular BOP is a static annular BOP and includes one or more expandable elastomeric seal elements.

4. The workover unit of claim 1, wherein the traveling assembly further comprises one or more traveling slips positioned above the reciprocating riser.

5. The workover unit of claim 4, wherein the stationary assembly further comprises one or more stationary slips positioned above the one or more traveling slips.

6. The workover unit of claim 1 further comprising an actuation mechanism positioned between the traveling assembly and the stationary assembly for reciprocating the traveling assembly relative to stationary assembly.

7. The workover unit of claim 1, wherein the traveling assembly further comprises a traveling annular BOP from which the reciprocating riser extends and wherein the traveling annular BOP and lower annular BOP are static BOPs.

8. The workover unit of claim 1, further comprising a tubular extending between the dynamic BOP and the lower annular BOP, wherein the tubular has a tubular diameter that is larger than the riser diameter of the reciprocating riser.

9. The workover unit of claim 1, wherein the flow loop is coupled to an outlet port below the lower annular BOP, and wherein the source of the equalization fluid is a source of well fluid coupled to the outlet port.

10. A method of snubbing a production string using a workover unit comprising:

positioning a production string in a riser;

activating a first static annular BOP to engage the production string with a static sealing element of the first static annular BOP;

opening an equalization port in fluid communication with the dynamic annular riser to inject an equalization fluid into the dynamic annular riser from a pipe loop coupled to the equalization port;

activating a second static annular BOP to disengage a static sealing element of the second static annular BOP from the production string; and moving the production string and riser in conjunction with one another by passing the riser through a dynamic BOP.

11. The method of claim 10, further comprising supporting the production string at a location above the first static annular BOP and further comprising lowering the production string into a wellbore.

12. The method of claim 11, wherein lowering the production string into a wellbore comprises retracing a reciprocating jack and moving the riser downward through the dynamic BOP.

13. The method of claim 10, further comprising supporting the production string at a location above the first static annular BOP; activating the second static annular BOP to engage the production string with the static sealing element of the second static annular BOP; activating the first static annular BOP to disengage the static sealing element of the first static annular BOP from the production sting; and further comprising raising the production string from a wellbore.

14. The method of claim 13, wherein raising the production string from a wellbore comprises extending a reciprocating jack and moving the riser upward through the dynamic BOP.

15. The method of claim 13, wherein activating the first static annular BOP to disengage the static sealing element of the first static annular BOP from the production string comprises deflating the static sealing element of the first static annular BOP; and wherein activating the second static annular BOP to engage static sealing element of the second static annular BOP with the production string comprises deflating the static sealing element of the second static annular BOP.

16. The method of claim 10, wherein activating the first static annular BOP comprises inflating a first the static sealing element of the first static annular BOP; and wherein activating the second static annular BOP comprises deflating the sealing element of the second static annular BOP.

17. The method of claim 10, wherein the step of opening the equalization port is performed prior to activating the second static annular BOP to disengage the static sealing element of the second static annular BOP from the production string.

18. A workover unit for moving a production string through a wellbore comprising:

a dynamic BOP supported on a workover frame having an upper end and a lower end;

a first static annular BOP axially aligned with the dynamic annular BOP and positioned between the dynamic BOP and the upper end of the workover frame;

a second static annular BOP axially aligned with the dynamic annular BOP and positioned below the dynamic BOP;

a reciprocating riser axially movable with the first static annular BOP;

an equalization port positioned above the second static annular BOP in fluid communication with the reciprocating riser; and a flow loop coupled to the equalization port, the flow loop in fluid communication with a source of an equalization fluid.

19. The workover unit of claim 18, wherein the lower end of the workover frame comprises a stationary assembly including the dynamic BOP and the upper end of the workover frame comprises a traveling assembly including the first static annular BOP and the reciprocating riser, and wherein the traveling assembly is axially movable relative to the stationary assembly.

20. The workover unit of claim 19, wherein the traveling assembly further comprises traveling slips supported on the workover frame between the first static annular BOP and the upper end of the workover frame.

* * * * *